US005080337A

United States Patent [19]

Mayer et al.

[11] Patent Number: 5,080,337

[45] Date of Patent: * Jan. 14, 1992

[54] APPARATUS AND METHOD FOR INDIVIDUALLY PRINTING SIGNATURES DURING DELIVERY TO A BINDERY LINE

[75] Inventors: Theodore W. Mayer, Chicago; Earl J. Anker, Glenwood; Gregory F. Reigel, Elburn, all of Ill.; F. G. E. Clarke, Essex, Conn.

[73] Assignee: R.R. Donnelley & Sons Company, Chicago, Ill.

[ * ] Notice: The portion of the term of this patent subsequent to Apr. 9, 2008 has been disclaimed.

[21] Appl. No.: 557,919

[22] Filed: Jul. 25, 1990

Related U.S. Application Data

[63] Continuation-in-part of Ser. No. 299,631, Jan. 23, 1989, abandoned.

[51] Int. Cl.[5] ..... B41F 13/54

[52] U.S. Cl. ..... 270/1.1; 270/54; 270/58

[58] Field of Search ..... 270/1.1, 54, 55, 56, 270/57, 58

[56] References Cited

U.S. PATENT DOCUMENTS 3,819,173 6/1974 Anderson ..... 270/54
4,582,312 4/1986 Abrams ..... 270/1.1
4,674,052 6/1987 Wong ..... 270/54
4,989,850 2/1991 Weller ..... 270/1.1

FOREIGN PATENT DOCUMENTS 3421208 12/1985 Fed. Rep. of Germany ..... 270/1.1

*Primary Examiner*—John T. Kwon
*Assistant Examiner*—Therese M. Newholm
*Attorney, Agent, or Firm*—Wood, Phillips, Mason, Recktenwald & VanSanten

[57] ABSTRACT

An apparatus and method for individually printing signatures during delivery to a bindery line where a plurality of signatures are provided at a feeding station for delivery to a binding line conveyor. The signatures are transferred by a transfer conveyor which extends from a point near the feeding station to a point near a binding line conveyor. A main drum assembly preferably moves the signatures one at a time from the feeding station to the transfer conveyor which follows a path to a delivery drum assembly where the signatures are delivered one at a time from the transfer conveyor to the binding line conveyor. The transfer conveyor is adapted to receive one signature at a time from the main drum assembly after which the transfer conveyor carries the signatures to the delivery drum assembly which delivers signatures one at a time for deposit on the binding line conveyor. In addition, the signatures are individually printed by a non-contact printer in a direction perpendicular to the backbones thereof during the course of signature transfer by the transfer conveyor.

41 Claims, 8 Drawing Sheets

FIG. 3
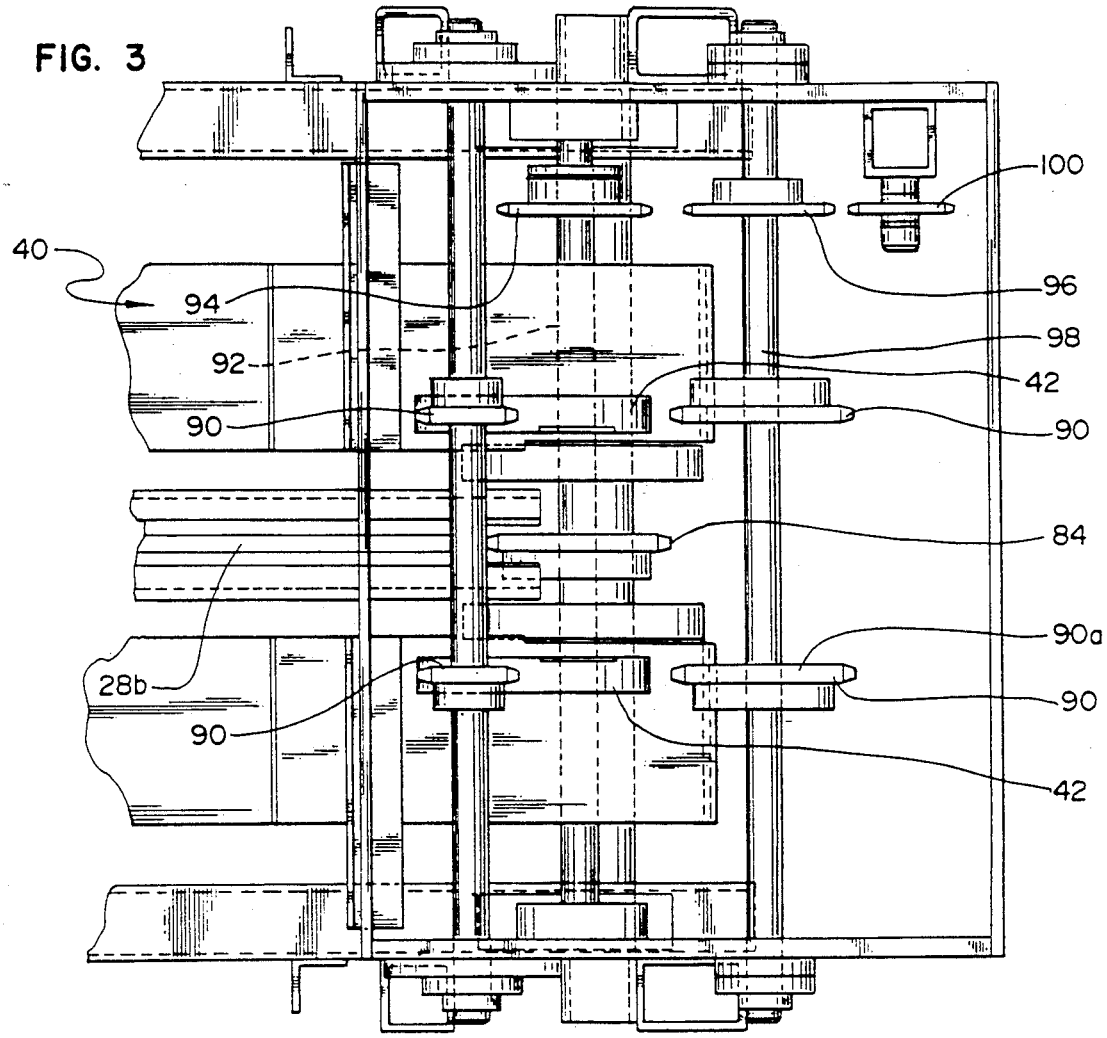
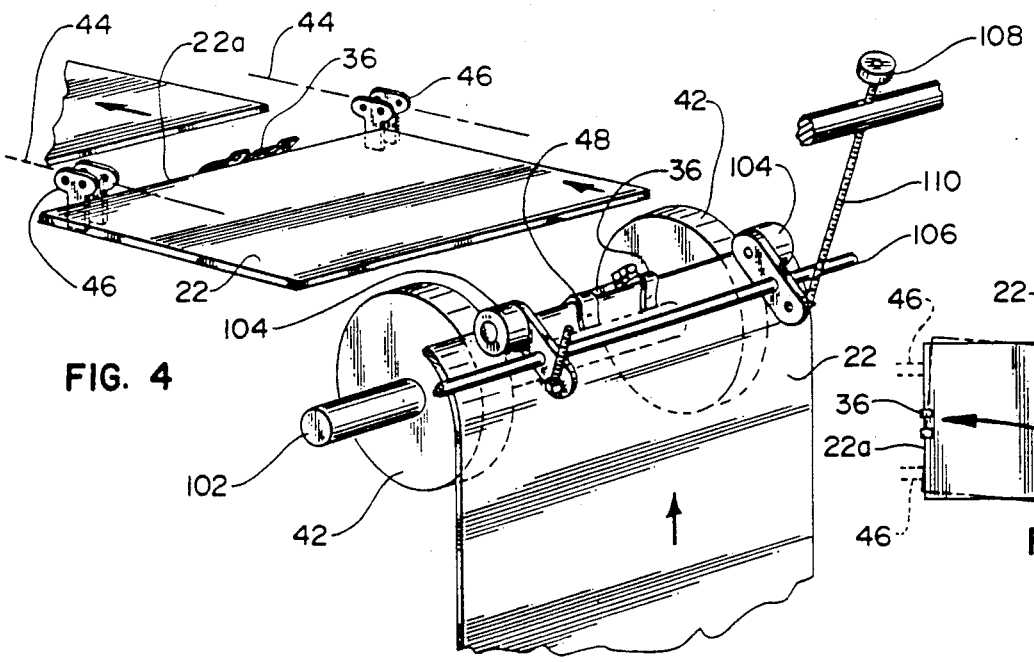
FIG. 4
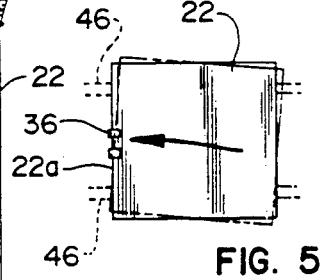
FIG. 5

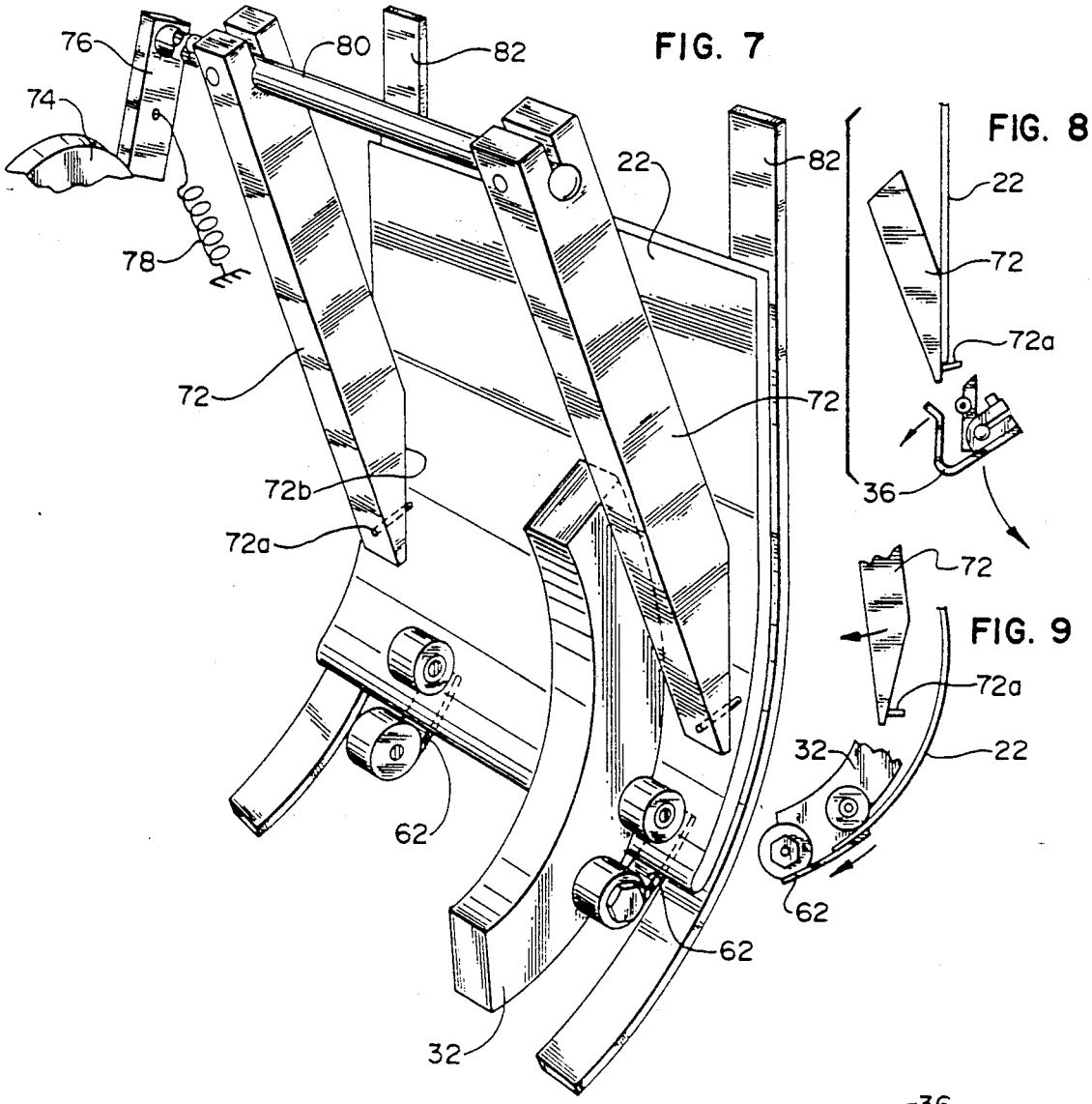
76
74
78
80
82
22
72
72b
72a
62
32
FIG. 7
FIG. 8
36
FIG. 9
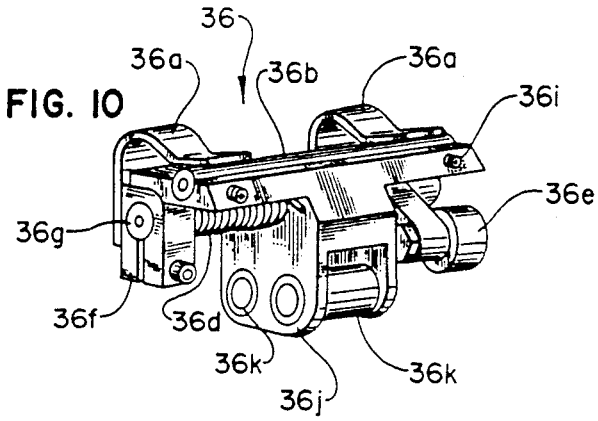
FIG. 10
36
36a
36b
36i
36e
36g
36f
36d
36k
36j
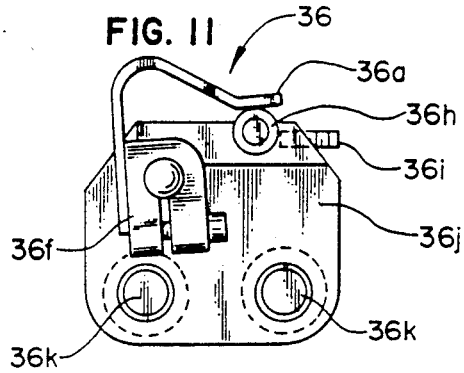
FIG. 11
36
36a
36h
36i
36j
36f
36k
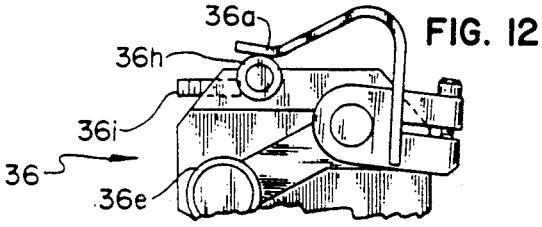
FIG. 12
36a
36h
36i
36
36e

APPARATUS AND METHOD FOR INDIVIDUALLY PRINTING SIGNATURES DURING DELIVERY TO A BINDERY LINE

CROSS-REFERENCE

This is a continuation-in-part of commonly owned and co-pending related application Ser. No. 299,631, filed on Jan. 23, 1989, entitled "Apparatus and Method for Individually Printing Signatures During Delivery to a Bindery Line", now abandoned.

FIELD OF THE INVENTION

The present invention generally relates to delivering signatures to a binding line conveyor and, more particularly, to an apparatus and method for individually printing signatures during such delivery.

BACKGROUND OF THE INVENTION

In recent years, many large circulation periodicals have appeared which require rapid handling of portions of the periodicals consisting of signatures which are gathered for binding, trimmed, bundled for minimum shipping costs, and shipped. A typical operation utilizes a multitude of inserter pockets each of which receives signatures seriatum from a signature supply means, opens each signature, and drops the signatures to successively straddle a gathering chain that runs in front of the inserter pockets, and carries the complete collection of gathered signatures to a location for further processing to complete the binding process. Moreover, because of the need for highly efficient plant operations, there has been a constant effort to increase the speed at which machines operate which has required the development of new techniques for handling the signatures at all stages of the binding process.

In addition to high speed operation, many large circulation periodicals are now demanding a degree of flexibility that has heretofore been considered impossible. This is particularly true, for instance, where the periodical wishes to include one or more personalized messages or other customized information or the like, but this must be done without significant reduction in the cyclic rate of operation that would otherwise decrease plant efficiency thereby increasing costs while possibly failing to accommodate the high volume presently produced by the U.S. printing industry which requires that the most efficient possible use be made of manpower, equipment and plant space. Furthermore, since the need for individualized message printing is sporadic, the equipment to achieve this objective should be compatible with a normal bindery line.

In the past, the only known manner of printing an individualized message on an internal signature in a binding operation has been less than entirely satisfactory. More specifically, it is known to print such a message or information on such a signature, provided this is done only after the signature is on a binding line conveyor which means that, due to the high speed operation of a binding line conveyor coupled with the fact that the backbone travels in the direction of travel of the conveyor, any such printing had to be parallel to the backbone (see, for instance, U.S. Pat. Nos. 4,121,818 and 4,395,031). While this has sometimes been found to be acceptable for certain applications, it would be most desirable to also be able to print in a direction perpendicular to the backbone.

In other words, by printing in a direction perpendicular to the backbone, it would be possible to provide individualized messages oriented in a normal fashion. Thus, the individualized message could be incorporated directly into text already on a given page of a signature where it would appear that the original printing of the signature had incorporated that message. In this manner, large circulation periodicals could achieve a degree and level of flexibility that has heretofore been considered impossible.

Most recently, a successful apparatus and method for individually printing signatures during delivery to a binding line conveyor has been achieved. This apparatus and method is fully illustrated, described and claimed in commonly owned and copending patent application of Gunnar Auksi for: Apparatus and Method for Individually Printing Signatures During Delivery to a Binding Line Conveyor, U.S. Ser. No. 224,332, filed July 26, 1988. Despite the achievement of the apparatus and method of this earlier filed application, it has remained to further the availability of commercially satisfactory techniques.

SUMMARY OF THE INVENTION

Accordingly, the present invention is directed to an apparatus and method for individually printing signatures during transfer to a binding line conveyor. The apparatus includes a feeding station for receiving a plurality of signatures to be transferred to the binding line conveyor. It also includes signature transfer means extending between the feeding station and the binding line conveyor and means intermediate the feeding station and the signature transfer means for moving signatures one at a time from the feeding station to the signature transfer means which is then adapted to transfer signatures in a backbone first manner along a path extending from the signature moving means to a point near the binding line conveyor. The apparatus further includes means intermediate the signature transfer means and the binding line conveyor for delivering signatures one at a time from the signature transfer means to the binding line conveyor. With this arrangement, the present invention provides means for individually printing on the signatures one at a time in a direction perpendicular to backbones of the signatures at a point intermediate the signature moving and delivery means.

In a preferred embodiment, the feeding station receives the signatures with the backbones extending perpendicular to the path of signature transfer It is an additional feature of the invention that the signature transfer means transfers signatures with the backbones remaining perpendicular to the path of signature transfer. Further, the printing means is positioned so as to print on signatures in such a manner that the printing extends parallel to the path of signature transfer. Preferably, the feeding station includes a feed conveyor for holding the signatures with backbones of the signatures disposed on the feed conveyor. The signature transfer means also advantageously includes a transfer conveyor having a plurality of clips for gripping the backbones of the signatures. With these clips, it is possible to cause the signatures to be transferred to the signature transfer means in a backbone first manner.

With this arrangement, the printing means preferably comprises at least one non-contact or ink jet printer between the signature moving means and signature delivery means along the path of signature transfer.

Thus, the non-contact or ink jet printer is appropriately disposed upstream of the binding line conveyor and appropriately oriented such that the printing will extend perpendicular to the backbones of the signatures.

In a preferred embodiment, the signature moving means comprises a main drum means or assembly disposed between the feeding station and the signature transfer means for moving signatures one at a time from the feeding station to the signature transfer means. It is also contemplated that the signature transfer means, or transfer conveyor and clips arrangement, is adapted to transfer the signatures backbone first for printing by means of the ink jet printer in a direction perpendicular to the backbones which, during transport, extend perpendicular to the path of signature transfer. Also, in a preferred embodiment, the signature delivery means comprises a delivery drum means or assembly disposed between the signature transfer means and the binding line conveyor for delivering signatures one at a time from the signature transfer means to the binding line conveyor.

In an exemplary embodiment, the transfer conveyor is adapted to transfer signatures along a path at least a portion of which is generally horizontal. Thus, the non-contact or ink jet printer can print on the signatures during signature transfer along the generally horizontal portion of the signature transfer path. By way of further explanation, the transfer conveyor may include additional signature transfer path portions accommodating printer location upstream of the binding line conveyor.

More specifically, the transfer conveyor may include at least a first vertical portion extending vertically away from the feeding station in addition to the horizontal portion which will then extend horizontally away from the first vertical portion. Preferably, the first vertical portion of the transfer conveyor will extend vertically upward from the feeding station and the transfer conveyor will further include a second vertical portion extending vertically downward from the generally horizontal portion. Still further, the transfer conveyor may include a second horizontal portion extending horizontally toward the first vertical portion and a third vertical portion extending vertically downward from the second horizontal portion.

With this construction, a register alignment means or system is advantageously associated with the first of the generally horizontal portions of the transfer conveyor just upstream of the non-contact or ink jet printer. The register alignment means or system is adapted to realign and/or maintain the signatures in an orientation with the backbones extending perpendicular to the path of signature transfer. It is thereby adapted to ensure that the printing on the signatures extends parallel to the path of signature transfer. The register alignment means or system further includes a pair of friction drive wheels adapted to contact and drive the signatures along a short portion of the path of signature transfer. With this arrangement, it will be appreciated that the friction drive wheels are driven in the same direction and at the same speed as the transfer conveyor so as to contact the signatures adjacent the point where the first of the horizontal portions of the transfer conveyor extends horizontally away from the first vertical portion thereof.

More specifically, the register alignment means or system also includes a pair of retarding chains each having a plurality of corresponding evenly spaced lug stops travelling at a lower speed than the signatures as they are driven from the first vertical portion to the first of the horizontal portions of the transfer conveyor by the friction drive wheels. The clips of the transfer conveyor release the backbones of the signatures to accommodate driven movement of the signatures by the friction drive wheels. However, the clips of the transfer conveyor once again grip the backbones of the signatures after driven movement of the signatures by the friction drive wheels and after the signatures have come into contact with a corresponding pair of the lug stops so as to be realigned and/or maintained in an orientation with the backbones extending perpendicular to the path of signature transfer. In one preferred embodiment, the transfer conveyor is adapted to transfer signatures along a path which is entirely horizontal. Thus, the non-contact or ink jet printer can print on the signatures during signature transfer along the entirely horizontal path.

Also in one preferred embodiment, the feeding station receives the signatures in a vertical stack in which individual signatures are horizontally oriented and unfolded with the backbones perpendicular to the path of travel. The main drum means includes a rotary feeder capable of moving signatures one at a time from the feeder station to the signature transfer means. It is contemplated that the transfer conveyor and clips arrangement is adapted to transfer the signature folio first for printing by means of the ink jet printer in a direction perpendicular to the backbones which, during transport, extend perpendicular to the path of signature transfer. The signature transfer means may be so adapted as to allow printing on either side of the signature during signature transfer. Thus, a non-contact or ink jet printer may be disposed on either side of the transfer conveyor means. Preferably, a chopper/folder means or assembly is disposed immediately upstream of the signature delivery means for the folding of signatures one at a time prior to transfer to the signature delivery means.

As for additional details, the transfer conveyor preferably includes a continuous gripper chain which carries the plurality of clips that grip the backbones of the signatures. The clips are mounted on the gripper chain to extend generally perpendicular thereto at evenly spaced intervals entirely along the length thereof. Additionally, the clips each traverse the signature transfer path from a point near the feeding station to a point near the binding line conveyor and back to the point near the feeding station.

In an exemplary embodiment, the main drum means or assembly includes signature gripping means mounted for rotation therewith. The signatures gripping means may, for example, comprise grippers adapted to grip the signatures one at a time to move the signatures one at a time to the clips mounted on the continuous gripper chain. With this arrangement, the grippers release the signatures at a preselected point of travel when the signatures have been gripped by the clips on the continuous gripper chain.

Also, in an exemplary embodiment, the delivery drum means or assembly includes signature opening means mounted for rotation therewith. The signature opening means may, for example, comprise grippers adapted to close on separate folios of the signatures at a preselected point of travel and then to separate the folios to deposit the signatures one at a time on the binding line conveyor. With this arrangement, the grippers release the signatures at a preselected point of travel for deposit on the binding line conveyor.

In addition, the present invention is directed to a method for individually printing signatures during transfer to a binding line conveyor which includes the step of providing a plurality of signatures at a feeding station for transfer to the binding line conveyor. It also includes the step of transferring one signature at a time from the plurality of signatures backbone first along a path extending from the feeding station to the binding line conveyor. Still further, the method includes the step of individually printing on the signatures in a direction perpendicular to backbones thereof during signature transfer along the path of signature transfer, preferably by means of a non-contact or ink jet printer.

Still other objects, advantages and features of the present invention will become apparent from a consideration of the following specification taken in conjunction with the accompanying drawings.

BRIEF DESCRIPTION OF THE DRAWINGS

In the Drawings:

FIG. 3 is a top plan view of a register alignment system for the apparatus illustrated in FIG. 2;

FIG. 4 is a perspective view illustrating operation of the register alignment system shown in FIG. 3;

FIG. 5 is a top plan view illustrating the register alignment system causing a signature to be aligned;

FIG. 7 is a perspective view of a portion of the apparatus of FIG. 6;

FIG. 8 is a side elevational view illustrating operation of the apparatus portion illustrated in FIG. 7;

FIG. 9 is a side elevational view further illustrating operation of the apparatus portion illustrated in FIG. 7;

FIG. 10 is a perspective view of a clip for the apparatus illustrated in FIG. 2;

FIG. 11 is a first end elevational view of the clip illustrated in FIG. 10;

FIG. 12 is a second end elevational view of the clip illustrated in FIG. 10;

DETAILED DESCRIPTION OF THE PREFERRED EMBODIMENT

Figure 1:
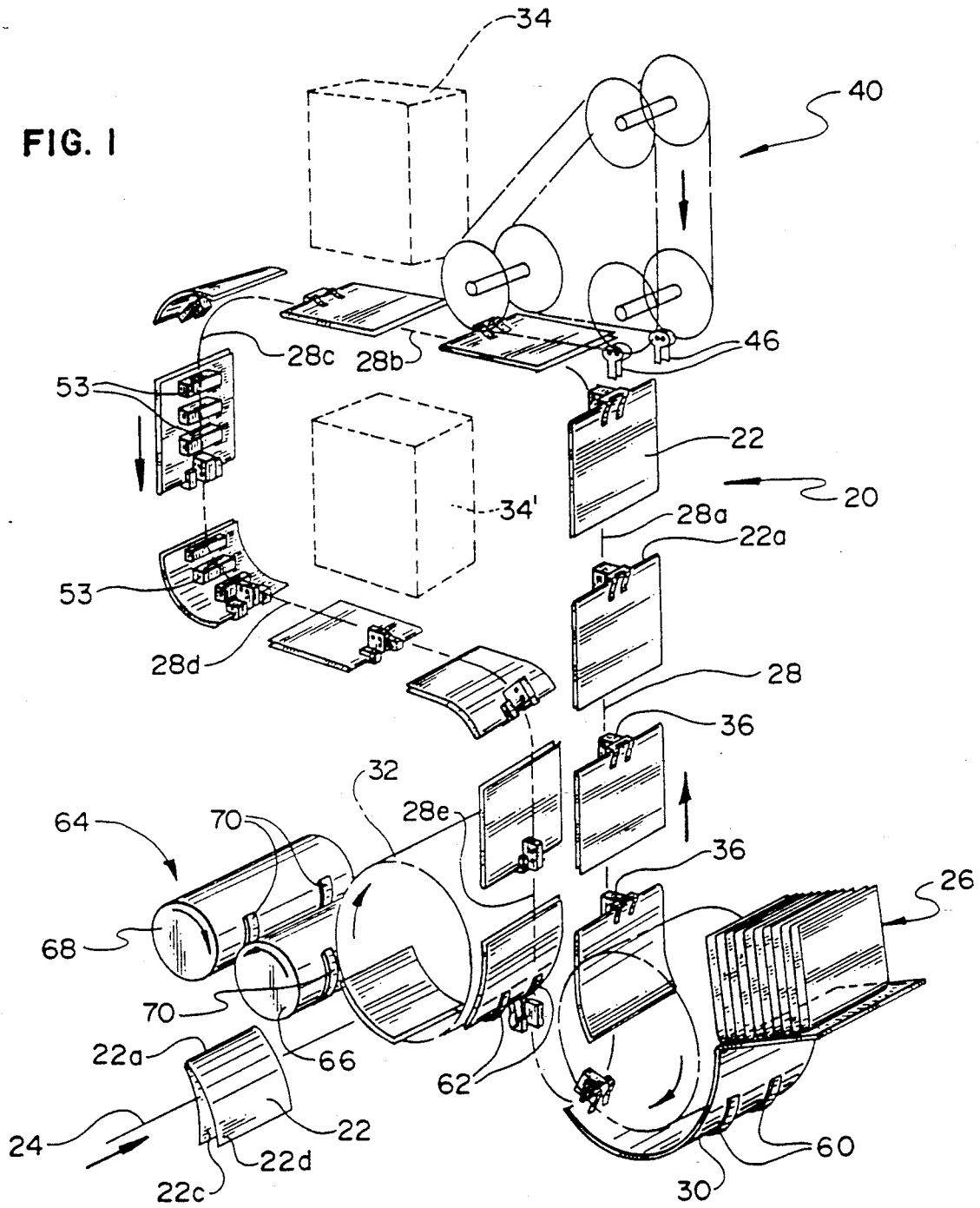
FIG. 1 is a schematic representation illustrating the concept of printing on signatures in a direction perpendicular to the backbone in accordance with the present invention.

Referring to the drawings, and first to FIG. 1, the reference numeral 20 designates generally an apparatus for individually printing signatures 22 during transfer to a binding line conveyor 24. The apparatus 20 includes a feeding station 26 for receiving a plurality of signatures 22 to be transferred to the binding line conveyor 24. It also includes signature transfer means such as the transfer conveyor 28 extending between the feeding station 26 and the binding line conveyor 24, i.e., from a point near the feeding station 26 to a point near the binding line conveyor 24. A main drum means or assembly 30 is provided intermediate the feeding station 26 and the transfer conveyor 28 and is adapted to move one signature 22 at a time from the plurality of signatures 22 at the feeding station 26 to the transfer conveyor 28. The transfer conveyor 28 is adapted to receive one signature 22 at a time from the main drum means or assembly 30 for transfer along a path extending from the main drum means or assembly 30 to a point near the binding line conveyor 24. Delivery drum means or assembly 32 is provided intermediate the transfer conveyor 28 and the binding line conveyor 24 to deliver one signature 22 at a time from the transfer conveyor 28 to the binding line conveyor 24. The apparatus 20 also includes printing means such as a non-contact printer 34 for individually printing on the signatures 22 one at a time in a direction perpendicular to their backbones **22*a* at a point intermediate the main drum means or assembly 30 and the delivery drum means or assembly 32. It further includes an arrangement whereby the transfer conveyor 28 transfers signatures 22 with the backbones 22*a* extending perpendicular to the path of signature transfer. More specifically, the transfer conveyor 28 preferably has a plurality of clips 36 for gripping the backbones 22*a* so as to cause the signatures 22** to be transferred backbone first in this particular orientation.

As best shown in FIG. 1, the feeding station 26 receives the signatures 22 in a stack resting on the backbones **22*a* which extend perpendicular to the path of signature transfer. The feeding station 26 also includes a feed conveyor 38 (see FIG. 2) for holding the signatures 22 in a stack with backbones 22*a* of the signatures 22 disposed on the feed conveyor. With this arrangement, the transfer conveyor 28 is well suited for receiving the signatures 22** from the stack for transfer backbone first perpendicular to the path of signature transfer.

Figure 2:
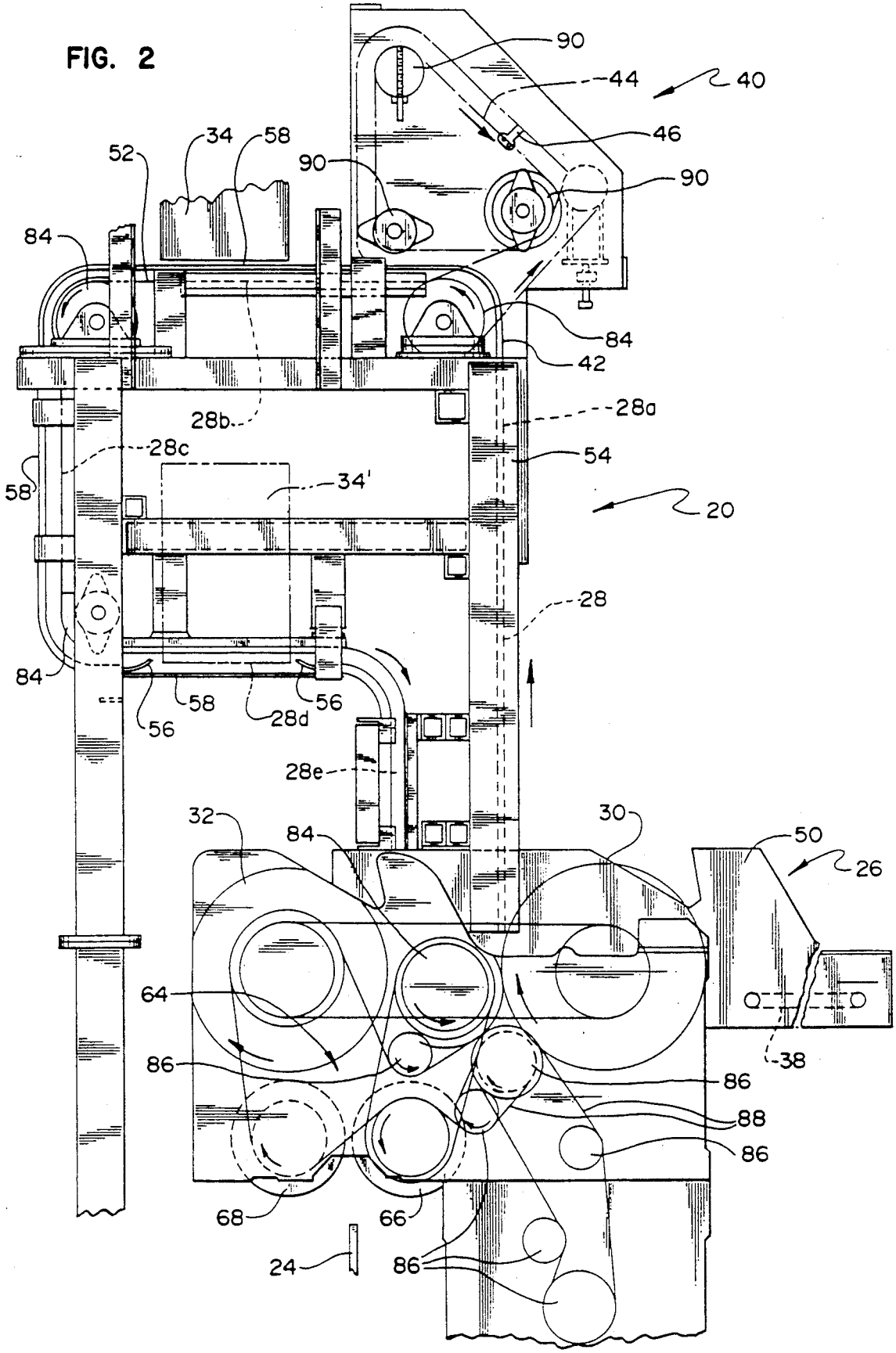
FIG. 2 is a side elevational view of an apparatus for practicing the concept of FIG. 1.

As will be appreciated by referring to FIGS. 1 and 2, the non-contact printer 34, which may advantageously comprise an ink jet printer, is adapted to print on the signatures 22 with the printing extending parallel to the path of signature transfer and perpendicular to the backbones **22*a* thereof. Still referring to the illustrations in FIGS. 1 and 2, the non-contact or ink jet printer 34 is advantageously disposed upstream of the binding line conveyor 24, i.e., at a point between the main drum assembly 30 and the delivery drum assembly 32**, along a generally horizontal portion of the signature transfer path.

As previously mentioned the transfer conveyor 28 has a plurality of clips 36 for gripping the backbones **22*a* to cause the signatures 22 to be transferred backbone first. It will also be seen that the transfer conveyor 28 includes at least a first vertical portion 28*a* extending vertically away from the feeding station 26 and a horizontal portion 28*b* extending horizontally away from the first vertical portion 28*a* and whereat the printing of the signatures 22 occurs by reason of the position of the non-contact or ink jet printer 34 directly thereabove. Preferably, the transfer conveyor 28 further includes a second vertical portion 28*c*, a second horizontal portion 28*d* and a third vertical portion 28*e***.

As shown in FIG. 1, the transfer conveyor 28 is formed such that the first vertical portion **28*a* extends vertically upward from the feeding station 26. It will also be seen that the second vertical portion 28*c* extends vertically downward from the first of the generally horizontal portions 28***b* whereat the printing of the signatures 22 takes place with the second horizontal portion 28*d* extending horizontally back toward the first vertical portion 28*a*. Furthermore, the transfer conveyor 28 is formed such that the third vertical portion 28*e* extends vertically downward from the second horizontal portion 28*d*.

Referring now to FIGS. 1 through 5, the apparatus 20 includes a register alignment means or system, generally designated 40, which is associated with the generally horizontal portion 28*b* of the transfer conveyor 28 upstream of the non-contact or ink jet printer 34. The register alignment means or system 40 is adapted to realign and/or maintain the signatures 22 in a proper orientation such that the backbones 22*a* extend perpendicular to the path of signature transfer, and it is also adapted to thereby ensure that the printing on the signatures 22 will extend parallel to the path of signature transfer and perpendicular to the backbones 22*a*. For this purpose, the register alignment means or system 40 includes a pair of friction drive wheels 42 together with a pair of retarding chains 44 each having a plurality of corresponding evenly spaced lug stops 46.

More specifically, and referring to FIG. 4, the friction drive wheels 42 contact the signatures 22 adjacent the point where the horizontal portion 28*b* of the transfer conveyor 28 extends horizontally away from the first vertical portion 28*a* thereof. It is a feature of the invention that the friction drive wheels 42 are driven in the same direction and at the same speed as the transfer conveyor 28 to drive the signatures around the radius defined at the juncture of the transfer conveyor portions 28*a* and 28*b* while the lug stops 46 travel at a lower speed than the signatures 22. With this arrangement, the clips 36 of the transfer conveyor 28 release the backbones 22*a* of the signatures 22 as at 48 for driven movement of the signatures 22 about the radius defined by the friction drive wheels 42.

When the backbones 22*a* of the signatures 22 have been released by the clips 36, the signature 22 at the point 48 is imparted with driven movement by the friction drive wheels 42. The friction drive wheels 42 cause the signature 22 to move forwardly into contact with the more slowly moving lug stops 46 (see FIG. 5) which causes realignment and/or maintenance of proper alignment of the signature 22 perpendicular to the path of signature transfer (and thus perpendicular to the transfer conveyor 28) just immediately upstream of the non-contact or ink jet printer 34. As this occurs, one of the clips 36 again grips the backbone 22*a* of the signature 22 to continue the advance of the signature 22 in a properly oriented fashion for printing.

As best shown in FIG. 2, the feed conveyor 38 is preferably disposed in a generally horizontal plane which is vertically spaced from the horizontal portion 28*b* of the transfer conveyor 28. The stack of signatures 22 is then disposed in a generally vertical (but slightly inclined) orientation thereon (see FIG. 1). Furthermore, the feeding station 26 preferably includes guide means such as a pair of guide or jogger plates such as 50 extending parallel to the feed conveyor 28 for cooperation with opposite side of the stack of signatures 22.

As shown in FIGS. 1 and 2, the transfer conveyor 28 includes a continuous gripper chain 22 with the clips 36 being mounted on the gripper chain 52 to extend generally perpendicular thereto and disposed at evenly spaced intervals entirely along the length thereof. It will also be seen that the continuous gripper chain 52 is provided with chain support lugs 53 which extend generally perpendicular thereto and are disposed at evenly spaced intervals along the length thereof to give support to the signatures 22, particularly as they change direction while traversing the path of signature transfer. Still further, the clips 36 each traverse the path from a point near the feeding station 26, i.e., at the main drum assembly 30, to a point near the binding line conveyor 24, i.e., at the delivery drum assembly 32, and back to the point near the feeding station 26.

Figure 6:
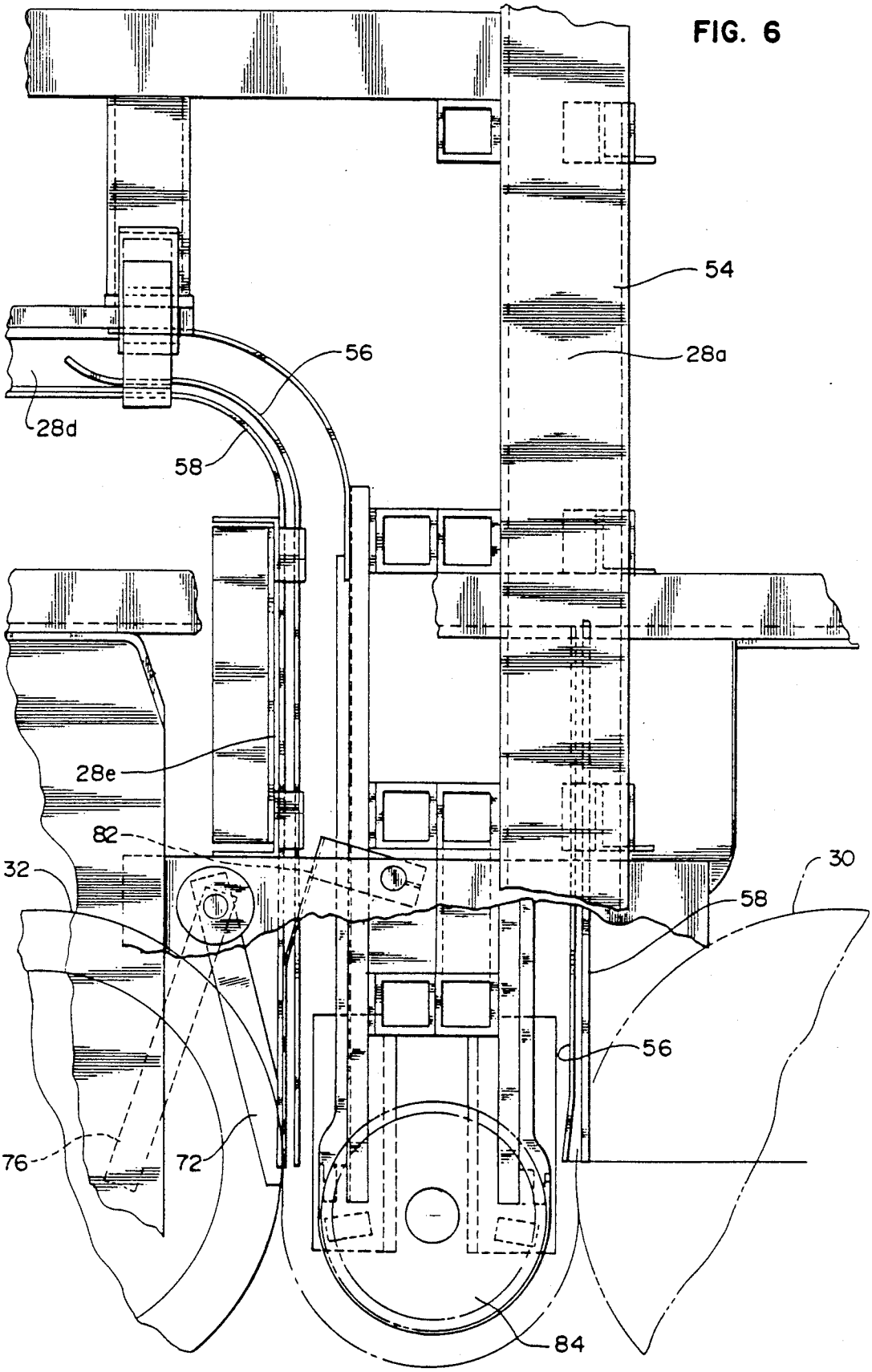
FIG. 6 is an enlarged side elevational view of a portion of the apparatus illustrated in FIG. 2.

Referring now to FIG. 6, the transfer conveyor 28 includes a supporting frame 54 and inner and outer signature guides 56 and 58 operatively associated with the supporting frame 54. It will be appreciated that the non-contact or ink jet printer 34 is operatively associated with the supporting frame 54 preferably vertically above the path of signature transfer (see FIGS. 1 and 2) whereby non-contact or ink jet printing is gravity assisted. For some applications, a second non-contact or ink jet printer 34' may be provided as well to provide maximum flexibility by accommodating printing on both sides of the signatures 22.

As shown in FIG. 2, the second non-contact or ink jet printer 34' will also be operatively associated with the supporting frame 54, and again preferably vertically above the path of signature transfer It will be positioned, however, just above the second horizontal portion 28*d* of the transfer conveyor 28. In this manner, one of the printers 34 is adapted to print on one side of the signatures 22 with the the printers 34' being adapted to print on the other side of the signatures 22.

As schematically illustrated in FIG. 1, the main drum assembly 30 includes signature gripping means or grippers 60 mounted for rotation therewith. The grippers 60 are adapted to grip the signatures 22 one at a time to move the signatures 22 to the clips 36 mounted on the continuous gripper chain 52. Moreover, the grippers 60 are adapted to release the signatures 22 at a preselected point of travel when the signatures 22 have been gripped by the clips 36.

Also as shown schematically in FIG. 1, the delivery drum assembly 32 includes signature gripping means or grippers 62 mounted for rotation therewith. The grippers 62 are adapted to grip the signatures 22 one at a time at a preselected point of travel and then to move the signatures 22 one at a time to signature opening means generally designated 64 for opening the signatures for deposit on the binding line conveyor 24. As will be appreciated, the grippers 62 release the signatures 22 at a preselected point of travel for opening by the signature transfer and opening means 64.

As for the signature transfer and opening means 64, it may typically take the form of a standard transfer drum 66 and opener drum 68 as used in the Harris Model FG Saddle Inserter, the details of which are hereby incorporated by reference. As there, the transfer drum 66 and opening drum 68 are mounted for rotation in opposite directions which, whether mounted in laterally offset relation to the delivery drum assembly 32 as shown in FIG. 1 in accordance with the typical arrangement for a Harris Model FG Saddle Inserter or directly beneath the delivery drum assembly 32 as shown in FIG. 2 in accordance with a typical McCain style inserter, each include signature opening means or grippers 70 mounted for rotation therewith. As will be appreciated, the grippers 70 are adapted to close on the folios 22*c* and 22*d* of the signatures 22 at a preselected point of travel and then to separate the folios to deposit the signatures 22 on the binding line conveyor 24 after the delivery drum assembly 32 has advanced the signature, e.g., to a register stop (not shown).

As for the delivery during assembly 32, it also includes reciprocating radial stop arms as shown in FIGS. 7 through 9. The reciprocating stop as are driven by means of a cam 74 through a cam follower 76 which is biased by a spring 78. As shown, the reciprocating stop arms 72 are carried by a rod or shaft 80 which also carries the cam follower 76 at one end thereof.

Still referring to FIG. 7, the reciprocating stop arms 72 carried by the rod or shaft 80 each include a stop pin 72*a* adjacent the end remote from the rod or shaft 80, i.e., the ends of the reciprocating stop arms 72 which have signature engagement surfaces 72*b* in which the pins 72*a* are disposed. With this arrangement, the reciprocating stop arms 72 will move into the path of travel of a signature 22 just as the clip 36 releases the backbone thereof (see FIG. 8) and will then move out of the path of travel just as the grippers 62 of the delivery drums assembly 32 begin to carry the signature therearound (see FIG. 9).

As previously mentioned, the signatures 22 may then suitably be carried to a register stop in conventional fashion (not shown). The grippers 62 will release the signature 22 as it approaches the register stop. At this point, the signature transfer and opening means 64 serves to open the signature 22 for deposit on the binding line conveyor 24.

As for the position of the reciprocating stop arms 72, this can best be appreciated by referring to FIG. 6 where the relative position of the cam follower 76 is also illustrated. Moreover, spring steel bands 82 are provided adjacent the path of travel of the signatures 22 and opposite the reciprocating stop arms 72 to push the signatures 22 thereagainst.

As will be appreciated from FIG. 2, the transfer conveyor 28 will include a plurality of sprockets 84 for the gripper chain 52 which will be driven off of the main drive shaft of the binding line and through other sprockets 86 and chains 88 in conventional fashion. Moreover, as will be appreciated, the main drum assembly 30, delivery drum assembly 32 and signature transfer and opening means 64 will be similarly driven off of the main drive shaft of the binding line.

As for the register alignment system 40, the details of construction and operation can be appreciated by referring to FIGS. 2 through 5. It is there illustrated that a system of sprockets 90 driven from the main drive shaft of the binding line are utilized to drive the pair of retarding chains 44. These retarding chains 44 carry the lug stops 46 against which the signatures 22 advance and realign prior to being gripped once again by the clips 36. More specifically, a shaft 92 carries the sprocket 84 adjacent the register alignment system 40 as well as a drive sprocket 94.

With this arrangement, the drive sprocket 94 is adapted to drive a transfer sprocket 96 which is mounted on a shaft 98 carrying the sprockets which have been specifically designated 90*a*. It will also be noted that an idler sprocket 100 is provided in order to achieve the proper direction of drive for the entire register alignment system 40. Since all of the sprockets 90 are interconnected by means of the retarding chains 44, the transfer sprocket 96 is adapted to transfer motion of the drive pulley 94 from the main drive shaft (not shown).

As shown in FIG. 4, the friction drive wheels 42 are carried on a shaft 102 which also carries the sprocket 84 adjacent the register alignment system 40. It will be seen that a pair of spring biased rollers 104 ride on the friction drive wheels 42 to ensure that driving motion is imparted to the signatures 22 after they have been released by the clips 36 and as they pass over the friction drive wheels 42. More specifically, and as shown, the spring biased rollers 104 are carried by a shaft 106 and arranged such that the biasing force can be adjusted by means of a threaded support 108 carrying the springs 110.

Referring now to FIGS. 10 through 12, the construction of the clips 36 can be understood since it is illustrated in some detail. It will be seen that the clips 36 each include a pair of spaced apart gripping fingers 36*a* which act against a gripping surface or surfaces 36*b* by reason of the biasing force of the spring 36*d* which causes the fingers 36*a* to normally be closed while a cam follower 36*e* is provided to open the fingers 36*a* upon engagement of conventional cams (not shown) as the signatures 22 reach the friction drive wheels 42 and again as the signatures 22 reach the reciprocating stop arms 72. For purposes of adjusting the biasing force of the spring 36*d*, an adjustment block 36*f* is positioned on a rod 36*g* carrying the spring 36*d*.

Still referring to FIG. 10 through 12, the fingers 36*a* act against a resilient pad or pads 36*h* which can be deformed by means of a set screw 36*i* to vary the action of the clips 36. It will also be seen that each of the clips 36 includes a centrally positioned yolk 36*j* carrying pins 36*k* by which the clips 36 are secured to the gripper chain 52. With these features, the clips 36 are well suited for transporting the signatures 22 in a backbone first manner about the path of signature transfer.

Figure 13:
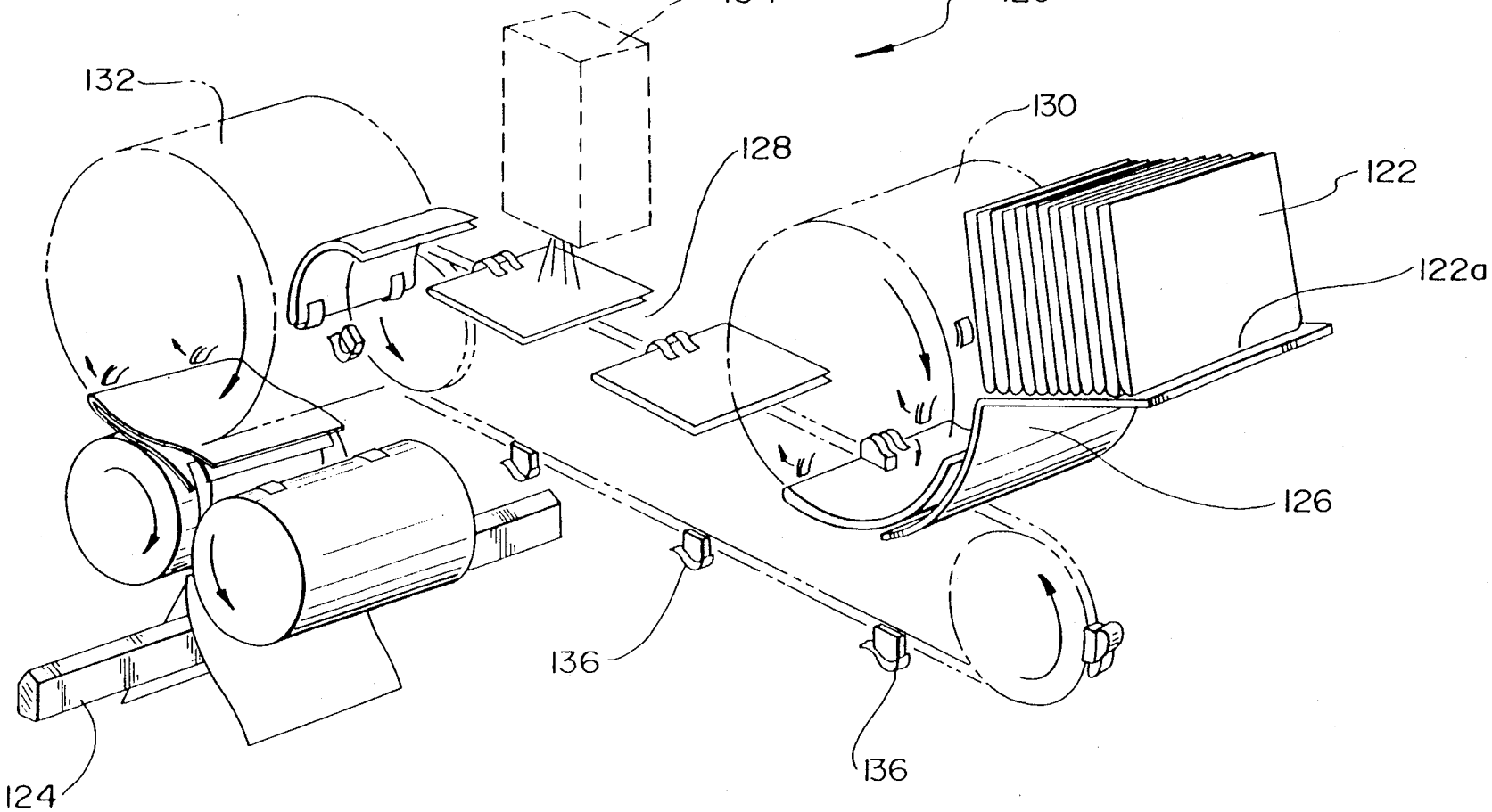
FIG. 13 is a schematic representation illustrating an alternate embodiment of the present invention.

Another preferred embodiment is shown in FIG. 13 where many elements are similar to those of the embodiment depicted in FIGS. 1–12. Accordingly, a similar labeling system has been used in FIG. 13. Where a feature of this embodiment is similar to one described for the embodiment of FIGS. 1–12, the reference numeral used in FIG. 13 is the reference numeral of the equivalent element of FIG. 1–12 with the addition of 100.

The reference numeral 120 designates an apparatus which includes a feeding station 126 for receiving a plurality of signatures 122 to be transferred to the binding line conveyor 124. It also includes signature transfer means such as the transfer conveyor 128 extending between the feeding station 126 and the binding line conveyor 124, i.e., from a point near the feeding station 126 to a point near the binding line conveyor 124. A main drum means or assembly 130 is provided intermediate the feeding station 126 and the transfer conveyor 128 and is adapted to move one signature 122 at a time from the plurality of signal&122 at the feeding station 126 to the transfer conveyor 128. The transfer conveyor 128 is adapted to receive one signature 122 at a time from the main drum means or assembly 130 for transfer along a path extending from the main drum means or assembly 130 to a point near the binding line conveyor 124. Delivery drum means or assembly 132 is provided generally horizontally spaced from the main drum means 130 and intermediate the transfer conveyor 128 and the binding line conveyor 124 to deliver one signature 122 at a time from the transfer conveyor 128 to the binding line conveyor 124. The apparatus 120 also includes printing means such as a non-contact printer 134 for individually printing on the signatures 122 one at a time in a direction perpendicular to their backbones 122*a* at a point intermediate the main drum means or assembly 130 and the delivery drum means or assembly 132. The transfer conveyor 128 preferably has a plurality of clips 136 for gripping the backbones 122*a* so as to cause the signatures 122 to be transferred backbone first. Preferably, the transfer conveyor 128 comprises an entirely horizontal portion directly intermediate the main drum means 130 and the delivery drum means 132 and extending away from the feeding station 126 and whereat the printing of the signatures 122 occurs by reason of the position of the non-contact or ink jet printer 134 directly thereabove.

Figure 14:
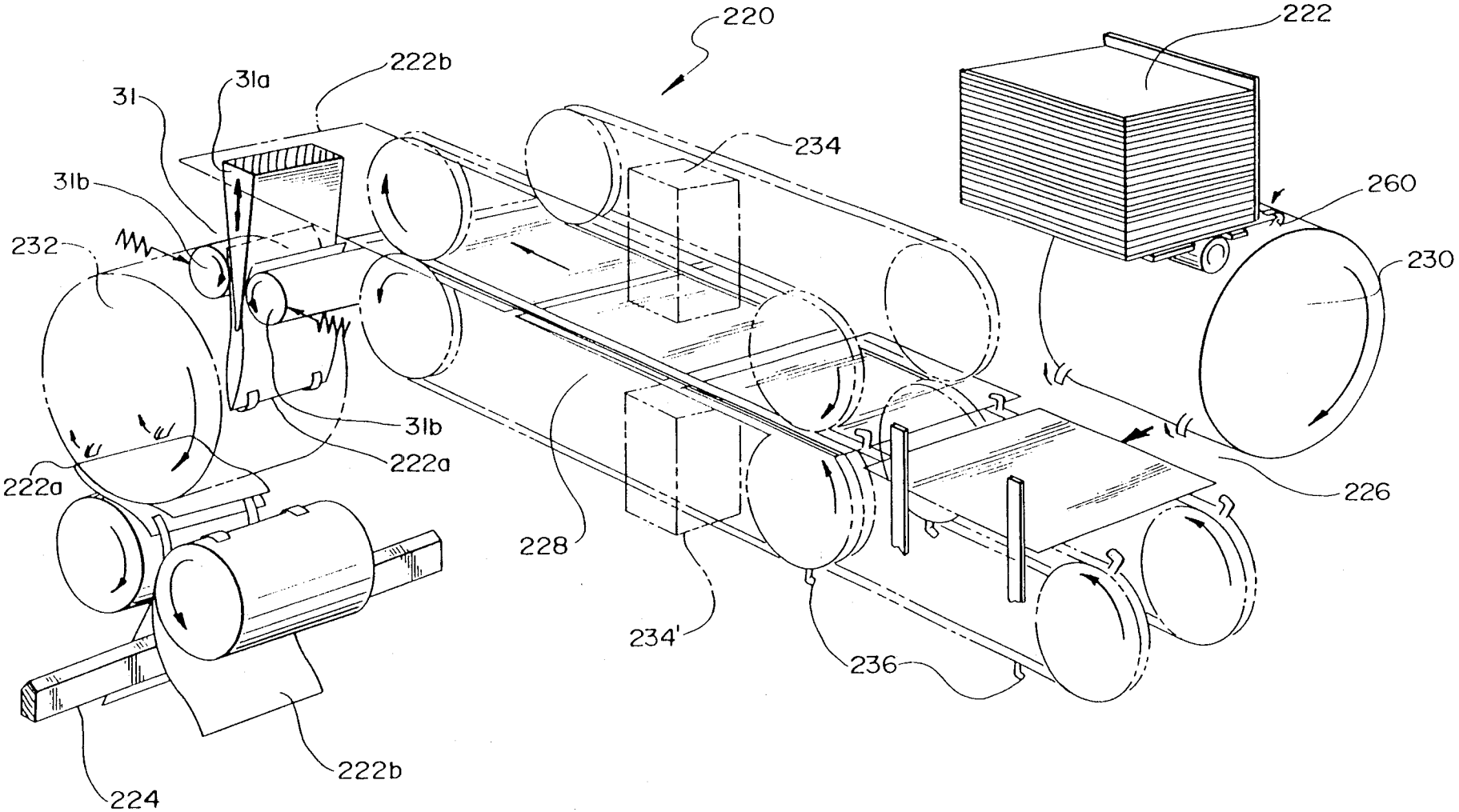
FIG. 14 is a schematic representation illustrating a second alternate embodiment of the present invention.
Figure 15:
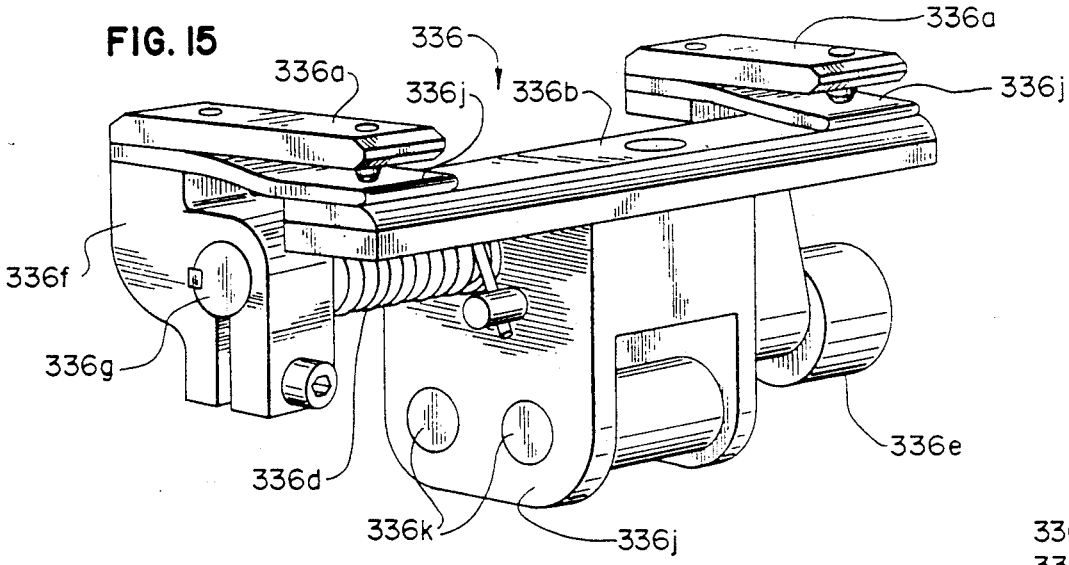
FIG. 15 is a perspective view of an alternative clip for the apparatus illustrated in FIG. 2.
Figure 16:
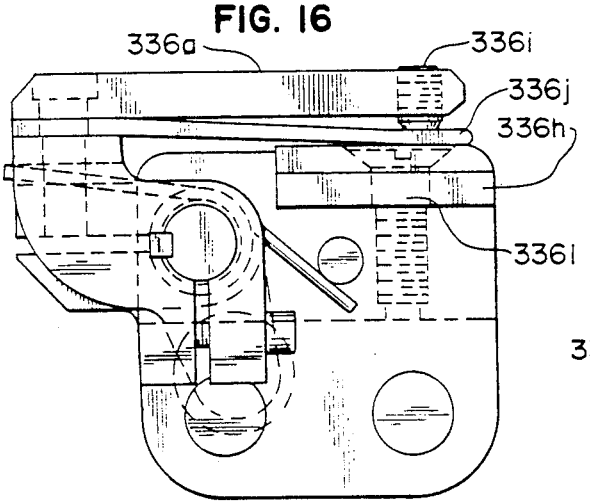
FIG. 16 is a first end elevational view of the clip illustrated in FIG. 15.
Figure 17:
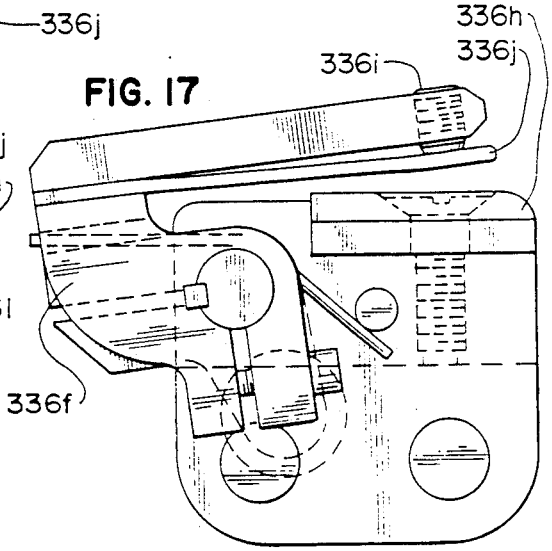
FIG. 17 is a second end elevational view of the clip illustrated in FIG. 15.
Figure 18:
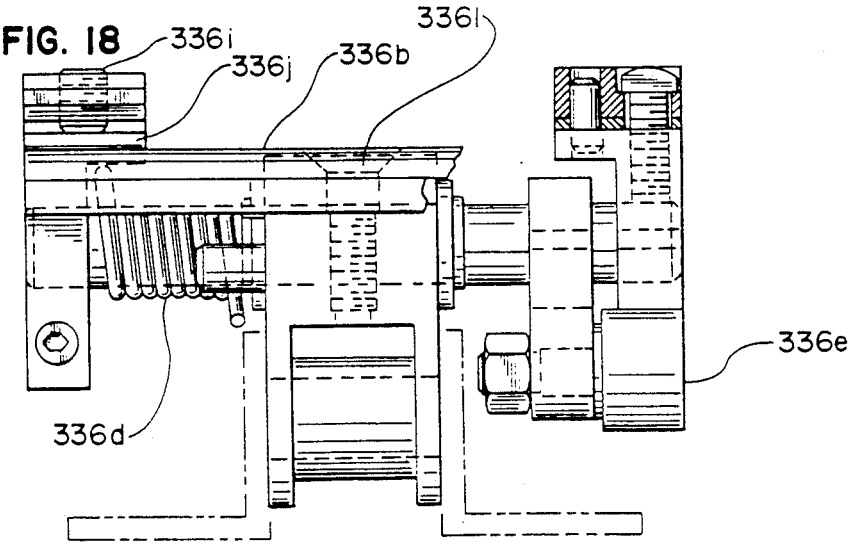
FIG. 18 is a front elevational view of the clip illustrated in FIG. 15.

Still another preferred embodiment is shown in FIG. 14 where many elements are again similar to those of the embodiment depicted in FIGS. 1-12. Accordingly, a similar labeling system has been used in FIG. 14. Where a feature of this embodiment is similar to one described for the embodiment of FIGS. 1-12, the reference numeral used in FIG. 14 is the number of the equivalent element of FIGS. 1-12 with the addition of 200.

The reference numeral 220 designates an apparatus which includes a feeding station 226 for receiving a plurality of signatures 222 to be transferred to the binding line conveyor 224. It also includes signature transfer means such as the transfer conveyor 228 extending between the feeding station 226 and a point near the binding line conveyor 224. A main drum means or assembly 230 is provided intermediate the feeding station 226 and the transfer conveyor 228 and is adapted to move one signature 222 at a time from the plurality of signatures 222 at the feeding station 226 to the transfer conveyor 228. The transfer conveyor 228 is adapted to receive one signature 222 at a time from the main drum means or assembly 230 for transfer along a path extending from the main drum means or assembly 230 to a point near the binding line conveyor 224.

Delivery drum means or assembly 232 is provided intermediate the transfer conveyor 228 and the binding line conveyor 224 to deliver one signature 222 at a time from the transfer conveyor 228 to the binding line conveyor 224. Signature chopping and folding means or assembly 31 is disposed between the signature transfer conveyor 228 and delivery drum means 232. The apparatus 220 also includes printing means such as a non-contact printer 234 for individually printing on the signatures 222 one at a time in a direction perpendicular to their backbones 222*a* at a point intermediate the main drum means or assembly 230 and the chopping and folding means or assembly 31. The transfer conveyor 228 preferably has a plurality of clips 236 for gripping the folios 222*b* so as to cause the signatures 222 to be transferred folio first. Preferably, the transfer conveyor 228 comprises an entirely horizontal portion extending away from the feeding station 226 and whereat the printing of the signatures 222 occurs by reason of the position of the noncontact or ink jet printer 234 directly thereabove.

As shown in FIG. 14, the feeding station 226 receives vertically stacked signatures 222 in an open-faced horizontal orientation. Preferably, main drum means 230 comprises a rotary feeder including gripping means or grippers 260 mounted for rotation therewith. Main drum means 230 is capable of moving signatures 222 one at a time from a plurality of signatures 222 at the feeding station 226 to the transfer conveyor 228 while maintaining an open-face horizontal orientation. With this arrangement, the transfer conveyor 228 is well suited for receiving the signatures 222 from the stack for transfer folio first perpendicular to the path of signature transfer.

As will be appreciated by referring to FIG. 14, the non-contact printer 234 is adapted to print on the signatures 222 with the printing extending parallel to the path of signature transfer and perpendicular to the backbones 222*a* thereof. A second non-contact printer 234' may be positioned just under the transfer conveyor 228 for printing on the signatures 222 passing thereabove. In this manner, one of the printers 234 is adapted to print on one side of the signatures 222 with the other of the printers 234' being adapted to print on the other side of the signatures 222 in an open-faced orientation. Thus, by positioning printer means 234 and 234' on opposite sides of the transfer conveyor 228 in generally opposed relation, it is possible to print on each face of the signatures 222.

As will be further appreciated by referring to FIG. 14, folding means or assembly 31 is provided immediately upstream of signature delivery means 232 and comprises a signature folder 31*a* and twin counterrotating drums 31*b*. The signature folder 31*a* comes into contact with the backbones 222*a* of individual signatures 222 as the signatures 222 pass across the counterrotating drums 31*b* and acts in a vertical direction so as to feed the signatures 222 backbone first through the counterrotating drums 31*b*. With this arrangement, the signatures 222 are prepared for binding and transferred in a backbone first manner to the signature delivery means 232.

Another preferred embodiment of a clip is shown in FIGS. 15-18 where many elements are similar to those of the embodiment depicted in FIGS. 10-12. Accordingly, a similar labeling system has been used in FIGS. 15-18. Where a feature of this embodiment is similar to one described for the embodiment of FIGS. 10-12, the reference numeral used in FIG. 15-18 is the reference numeral of the equivalent element of FIG. 10-12 with the addition of 300.

Referring now to FIGS. 15 to 18, the construction of the clips 336 can be understood since one has been illustrated in some detail. It will be seen that the clips 336 each include a pair of spaced apart gripping fingers 336*a* which act against a gripping surface or surfaces 336*b* by reason of the biasing force of the spring 336*d* when the fingers 336*a* are closed. The fingers 336*a* have clasps 336*j* which are positionably adjustable for forced engagement with the gripping surface 336*b* by means of set screws 336*i* which extend through the ends of the fingers 336*a* and into contact with the clasps 336*j*. A cam follower 336*e* is provided to open the fingers 336*a* against the biasing force of the spring 336*d* upon engagement of a conventional cam (not shown) as the signatures 22 reach the friction drive wheels 42 and again as the signatures 22 reach the reciprocating stop arms 72. For purposes of adjusting the biasing force of the spring 336*d*, an adjustment block 336*f* is positioned on a rod 336*g* carrying the spring 336*d*.

Still referring to FIG. 15 through 18, the clasps 336*j* of the fingers 336*a* act against a flat resilient pad or pads 336*h* which are secured to the clip 336 by means of a central counter-bored screw 3361 and can be deformed by means of advancing the set screws 336*i* within the fingers 336*a* such that the clasps 336*j* engage the resilient pads 336*h* to vary the action of the clips 336. It will also be seen that each of the clips 336 includes a centrally positioned yolk 336*j* carrying pins 336*k* by which the clips 336 are secured to the gripper chain 52. With this arrangement, the clips 336 can easily be adjusted to compensate for wear by means of the set screws 336*i* and the resilient pads 336*h* may easily be replaced.

With the present invention, a unique method for individually printing signatures 22 during transfer to a binding line conveyor 24 has been provided. It includes the step of providing a plurality of signatures 22 at a feeding station 26 for transfer to the binding line conveyor 24. The method further includes the step of transferring one signature 22 at a time from the plurality of signatures 22 backbone first along a path extending from the feeding station 26 to the binding line conveyor 24. It further includes the step of individually printing on the signatures 22 in a direction perpendicular to backbones 22*a* thereof during signature transfer along the path of signature transfer. Preferably, the plurality of signatures 22 is provided with the backbones 22*a* extending perpendicular to the direction of travel during transfer of the signatures 22 to the binding line conveyor 24.

Still more specifically, the method contemplates the signatures 22 each being individually printed before delivery to the binding line conveyor 24. The signature is printed such that the printing extends parallel to the path of signature transfer during transfer of the signatures to the binding line conveyor 24. Most advantageously, the signatures 22 are each printed by means of a non-contact printer which may advantageously be of the ink jet type.

While in the foregoing there has been set forth a preferred embodiment of the invention, it will be appreciated that the details herein given may be varied without departing from the spirit and scope of the appended claims.

I claim:

1. An apparatus for individually printing signatures during transfer to a binding line conveyor, comprising:

a feeding station for receiving a plurality of signatures to be transferred to said binding line conveyor;

signature transfer means extending between said feeding station and said binding line conveyor;

means intermediate said feeding station and said signature transfer means for moving signatures one at a time from said feeding station to said signature transfer means;

said signature transfer means including a transfer conveyor having a plurality of clips for gripping backbones of said signatures and being adapted to transfer signatures in a backbone first manner along a path extending from said signature moving means to a point near said binding line conveyor;

means intermediate said signature transfer means and said binding line conveyor for delivering signatures one at a time from said signature transfer means to said binding line conveyor; and means for individually printing on said signatures one at a time in a direction perpendicular to backbones of said signatures at a point intermediate said signature moving means and said signature delivery means.

2. The apparatus as defined in claim 1 wherein said feeding station receives said signatures with the backbones extending perpendicular to said path of signature transfer.

3. The apparatus as defined in claim 1 wherein said signature transfer means transfers said signatures with the backbones extending perpendicular to said path of signature transfer.

4. The apparatus as defined in claim 1 wherein said printing means prints on said signatures with the printing extending parallel to said path of signature transfer.

5. The apparatus as defined in claim 1 wherein said printing means includes at least one ink jet printer between said signature moving means and said signature delivery means along said path of signature transfer.

6. An apparatus for individually printing signatures during transfer to a binding line conveyor, comprising:

a feeding station for receiving a plurality of signatures to be transferred to said binding line conveyor;

signature transfer means extending between said feeding station and said binding line conveyor;

main drum means disposed between said feeding station and said signature transfer means for moving signatures one at a time from said feeding station to said signature transfer means;

said signature transfer means including a transfer conveyor having a plurality of clips for gripping the backbones of said signatures and being adapted to receive one signature at a time from said main drum means for transfer along a path extending from said main drum means to a point near said binding line conveyor;

delivery drum means disposed between said signature transfer means and said binding line conveyor for delivering signatures one a time from said signature transfer means to said binding line conveyor; and means for individually printing on said signatures one at a time in a direction perpendicular to backbones of said signatures at a point intermediate said main drum means and said delivery drum means.

7. The apparatus as defined in claim 6 wherein said feeding station receives said signatures with the backbones extending perpendicular to said path of signature transfer.

8. The apparatus as defined in claim 6 wherein said signature transfer means transfers said signatures with the backbones extending perpendicular to said path of signature transfer.

9. The apparatus as defined in claim 6 wherein said printing means prints on said signatures with the printing extending parallel to said path of signature transfer.

10. The apparatus as defined in claim 6 wherein said transfer conveyor transfers said signatures backbone first with backbones extending perpendicular to said path of signature transfer.

11. The apparatus as defined in claim 6 wherein said printing means includes at least one ink jet printer between said main drum means and said delivery drum means along said path of signature transfer.

12. An apparatus for individually printing signatures during transfer to a binding line conveyor, comprising:

a feeding station for receiving a plurality of signatures to be transferred to said binding line conveyor;

signature transfer means extending from a point near said feeding station to a point near said binding line conveyor, said signature transfer means being adapted to transfer signatures one at a time between said feeding station and said binding line conveyor. said signature transfer means being adapted to transfer signatures along a path at least a portion of which is generally horizontal; and means for individually printing on said signatures in a direction perpendicular to backbones thereof during signature transfer along said generally horizontal portion of said path;

said feeding station receiving said signatures with backbones of said signatures extending perpendicular to said path of signature transfer;

said signature transfer means transferring signatures with backbones of said signatures extending perpendicular to said path of signature transfer, said signature transfer means including a transfer conveyor having a plurality of clips for gripping backbones of said signatures to cause said signatures to be transferred backbone first;

said printing means printing on said signatures with the printing extending parallel to said path of signature transfer, said printing means including at least one noncontact printer upstream of said binding line conveyor along said path of signature transfer.

13. The apparatus as defined in claim 12 wherein said transfer conveyor transfers said signatures backbone first with backbones of said signatures extending perpendicular to said path of signature transfer.

14. The apparatus as defined in claim 12 wherein said transfer conveyor includes at least a first vertical portion extending vertically away from said feeding station and a horizontal portion extending horizontally away from said first vertical portion.

15. The apparatus as defined in claim 14 including register alignment means associated with said generally horizontal portion of said transfer conveyor upstream of said non-contact printer, said register alignment means being adapted to maintain said signatures in an orientation with backbones of said signatures extending perpendicular to said path of signature transfer, said register alignment means also being adapted to ensure the printing on said signatures extends perpendicular to backbones of said signatures.

16. The apparatus as defined in claim 15 wherein said register alignment means includes a pair of friction drive wheels adapted to contact said signatures along said path of signature transfer, said friction drive wheels contacting said signatures adjacent the point where said horizontal portion of said transfer conveyor extends horizontally away from said first vertical portion thereof, said friction drive wheels being driven in the same direction and at the same surface speed as said transfer conveyor.

17. The apparatus as defined in claim 16 wherein said register alignment means also includes a plurality of pairs of retarding lug stops travelling at a lower speed than said signatures as they are driven from said first vertical portion to said horizontal portion of said transfer conveyor by said friction drive wheels, said clips of said transfer conveyor releasing backbones of said signatures for driven movement of said signatures by said friction drive wheels and again gripping backbones of said signatures after driven movement of said signatures by said friction drive wheels with said signatures in contact with a corresponding pair of said lug stops.

18. The apparatus as defined in claim 12 wherein said feeding station includes guide means for directing said stack of signatures toward said transfer conveyor, said guide means including a pair of guide plates extending parallel to said feeding station for cooperation with opposite sides of said stack of signatures.

19. The apparatus as defined in claim 14 wherein said first vertical portion of said transfer conveyor extends vertically away from said feeding station, said transfer conveyor including a second vertical portion extending vertically from said generally horizontal portion in a direction opposite said first vertical portion.

20. The apparatus as defined in claim 19 wherein said transfer conveyor further includes a second horizontal portion extending horizontally toward said first vertical portion and a third vertical portion extending vertically downward from said second horizontal portion.

21. The apparatus as defined in claim 12 wherein said transfer conveyor includes a continuous gripper chain, said clips being mounted on said gripper chain to extend generally perpendicular thereto at evenly spaced intervals entirely along the length thereof, said clips each traversing said path from a point near said feeding station to a point near said binding line conveyor and back to said point near said feeding station.

22. An apparatus for individually printing signatures during transfer to a binding line conveyor, comprising:

a feeding station for receiving a plurality of signatures to be transferred to said binding line conveyor;

signature transfer means extending from a point near said feeding station to a point near said binding line conveyor;

main drum means intermediate said feeding station and said signature transfer means adapted to move one signature at a time from said plurality of signatures at said feeding station to said signature transfer means;

delivery drum means intermediate said signature transfer means and said binding line conveyor adapted to deliver one signature at a time from said signature transfer means to said binding line conveyor;

said signature transfer means being adapted to transfer signatures along a path at least a portion of which is generally horizontal: and means for individually printing on said signatures in a direction perpendicular to backbones thereof during signature transfer along said generally horizontal portion of said path:

said feeding station receiving said signatures with backbones of said signatures extending perpendicular to said path of signature transfer, said feeding station including a feed conveyor for holding said signatures in a stack with backbones of said signatures disposed on said feed conveyor;

said signature transfer means transferring signatures with backbones of said signatures extending perpendicular to said path of signature transfer, said signature transfer means including a transfer conveyor having a plurality of clips for gripping backbones of said signatures to cause said signatures to be transferred to said signature transfer means;

said transfer conveyor including a first vertical portion extending vertically away from said feeding station and a horizontal portion extending horizontally away from said first vertical portion, said first vertical portion of said transfer conveyor extending vertically away from said feeding station, said transfer conveyor also including a second vertical portion extending vertically downward from said horizontal portion in a direction opposite said first vertical portion, a second horizontal portion extending horizontally toward said first vertical portion and a third vertical portion extending vertically away from said second horizontal portion;

said transfer conveyor further including a continuous gripper chain and said clips being mounted on said gripper chain to extend generally perpendicular thereto, said clips being disposed at evenly spaced intervals entirely along the length thereof, said clips each traversing said path from said main drum means to said delivery drum means and returning to said main drum means;

said printing means printing on said signatures with the printing extending parallel to said path of signature transfer, said printing means including at least one noncontact printer upstream of said binding line conveyor along said path of signature transfer.

23. The apparatus as defined in claim 22 wherein said transfer conveyor includes a supporting frame and inner and outer guides for said signatures operatively associated with said supporting frame, and said non-contact printer comprises an ink jet printer operatively associated with said supporting frame along said path of signature transfer.

24. The apparatus as defined in claim 23 including at least a pair of ink jet printers, one of said printers being adapted to print on one side of said signatures, the other of said printers being adapted to print on the other side of said signatures.

25. The apparatus as defined in claim 22 wherein said main drum means includes signature gripping means mounted for rotation therewith, said signature gripping means comprising grippers adapted to grip said signatures one at a time to move said signatures to said clips mounted on said continuous gripper chain, said grippers releasing said signatures at a preselected point of travel when said signatures have been gripped by said clips.

26. The apparatus as defined in claim 25 wherein said delivery drum means includes signature gripping means mounted for rotation therewith, said signature gripping means comprising grippers adapted to grip said signatures one at a time at a preselected point of travel and then to move said signatures one at a time to signature opening means prior to deposit of said signatures on said binding line conveyor, said grippers of said delivery drum means releasing said signature at a preselected point of travel for opening by said signature opening means.

27. The apparatus as defined in claim 22 including register alignment means associated with said transfer conveyor upstream of said non-contact printer, said register alignment means being adapted to maintain said signatures in an orientation with backbones of said signatures extending perpendicular to said path of signature transfer, said register alignment means also being adapted to ensure the printing on said signatures extends perpendicular to backbones of said signatures.

28. The apparatus as defined in claim 27 wherein said register alignment means includes a pair of friction drive wheels adapted to contact said signatures along said path of signature transfer, said friction drive wheels being driven in the same direction and at the same surface speed as said transfer conveyor.

29. The apparatus as defined in claim 30 wherein said register alignment means also includes a pair of retarding lug stops travelling at a lower speed than said signatures as said signatures are driven by said friction drive wheels, said clips of said transfer conveyor releasing backbones of said signatures for driven movement of said signatures by said friction drive wheels and again gripping backbones of said signatures after driven movement of said signatures by said friction drive wheels with said signatures in contact with a corresponding pair of said lug stops.

30. An apparatus for individually printing signatures during transfer to a binding line conveyor, comprising:

a feeding station for receiving a plurality of signatures to be transferred to said binding line conveyor signature transfer means extending between said feeding station and said binding line conveyor, said signature transfer means being adapted to transfer signatures one at a time between said feeding station and said binding line conveyor, said signature transfer means being adapted to transfer signatures along an entirely horizontal path;

main drum means disposed between said feeding station and said signature transfer means for moving signatures one at a time from said feeding station to said signature transfer means, said signature transfer means being adapted to receive one signature at a time from said main drum means;

delivery drum means generally horizontally spaced from said main drum means and intermediate said signature transfer means and said binding line conveyor adapted to deliver one signature at a time from said signature transfer means to said binding line conveyor said signature transfer means including a transfer conveyor having a plurality of clips for gripping backbones of said signatures to cause said signatures to be transferred along said entirely horizontal path intermediate said main drum means and said delivery drum means; and means for individually printing on said signatures one at a time in a direction perpendicular to backbones of said signatures at a point intermediate said main drum means and said delivery drum means during signature transfer along said entirely horizontal path.

31. The apparatus as defined in claim 30 wherein said feeding station receives said signatures with the backbones extending perpendicular to said path of signature transfer.

32. The apparatus as defined in claim 30 wherein said signature transfer means transfers said signatures with the backbones extending perpendicular to said path of signature transfer.

33. The apparatus as defined in claim 30 wherein said printing means prints on said signatures with the printing extending parallel to said path of signature transfer.

34. The apparatus as defined in claim 30 wherein said transfer conveyor transfers said signatures backbone first with the backbones extending perpendicular to said path of signature transfer.

35. The apparatus as defined in claim 30 wherein said delivery drum means includes signature gripping means mounted for rotation therewith, said signature gripping means comprising grippers adapted to grip said signatures one at a time at a preselected point of travel and then to move said signatures one at a time to signature opening means prior to deposit of said signatures on said binding line conveyor, said grippers of said delivery drum means releasing said signature at a preselected point of travel for opening by said signature opening means.

36. The apparatus as defined in claim 30 wherein said printing means includes at least one ink jet printer between said main drum means and said delivery drum means along said path of signature transfer.

37. An apparatus for individually printing signatures during transfer to a binding line conveyor, comprising:

a feeding station for receiving a plurality of signatures to be transferred to said binding line conveyor;

signature transfer means extending from a point near said feeding station to a point near said binding line conveyor, said signature transfer means being adapted to transfer signatures one at a time between said feeding station and said binding line conveyor, said signature transfer means being adapted to transfer signatures along a path at least a portion of which is generally horizontal; and means for individually printing on said signatures in a direction perpendicular to backbones thereof during signature transfer;

said feeding station receiving said signatures with backbones of said signatures extending perpendicular to said path of signature transfer;

said signature transfer means including a transfer conveyor having a plurality of clips for gripping backbones of said signatures to cause said signatures to be transferred backbone first;

said clips having a plurality of spring biased fingers with intermediate elements which act against a resilient pad and are adapted to be opened upon engagement of a cam follower mechanism and means for varying the action of said clips.

38. The apparatus as defined in claim 37 wherein said means for varying the action of said clips includes adjustable set screw means interengaged with said fingers and said intermediate elements for constraining said elements against said resilient pad.

39. The apparatus as defined in claim 38 wherein said means for varying the action of said clips includes an adjustable biasing spring.

40. The apparatus as defined in claim 37 wherein said resilient pad is removable.

41. The apparatus as defined in claim 47 wherein said resilient pad is secured to said clip by means of a removable fastener extending therethrough.

* * * * *